US006205226B1

(12) United States Patent
Senoo et al.

(10) Patent No.: US 6,205,226 B1
(45) Date of Patent: Mar. 20, 2001

(54) PIEZOELECTRIC ACOUSTIC DEVICE

(75) Inventors: Masao Senoo, Saitama-ken; Tsuyoshi Yamashita; Tadao Sunahara, both of Toyama Pref., all of (JP)

(73) Assignee: Hokuriku Electric Industry Co., Ltd., Toyama Pref. (JP)

( * ) Notice: Subject to any disclaimer, the term of this patent is extended or adjusted under 35 U.S.C. 154(b) by 0 days.

(21) Appl. No.: 09/272,793

(22) Filed: Mar. 19, 1999

(30) Foreign Application Priority Data

Jun. 22, 1998 (JP) ..... 10-174208

(51) Int. Cl.[7] ..... H04R 25/00

(52) U.S. Cl. ..... 381/190; 381/191; 310/311; 367/155; 367/157

(58) Field of Search ..... 381/190, 114, 381/173, 191; 310/311, 324, 322; 367/155, 157

(56) References Cited

U.S. PATENT DOCUMENTS

| | | | | |
|---|---|---|---|---|
| 3,903,733 | * | 9/1975 | Murayama et al. | 73/659 |
| 4,079,213 | | 3/1978 | Bage et al. . | |
| 4,674,161 | * | 6/1987 | Edinger et al. | 381/190 |
| 4,989,302 | | 2/1991 | Abe et al. . | |
| 5,321,761 | * | 6/1994 | Kitanshi | 381/190 |
| 5,490,220 | * | 2/1996 | Loeppert | 381/173 |
| 5,761,324 | * | 6/1998 | Kanai et al. | 381/190 |
| 5,784,340 | * | 7/1998 | Kanai | 381/190 |
| 5,907,625 | * | 5/1999 | Kanai et al. | 381/190 |
| 6,064,141 | * | 5/2000 | Wiciel | 310/339 |

* cited by examiner

*Primary Examiner*—Stella Woo
*Assistant Examiner*—Suhan Ni
(74) *Attorney, Agent, or Firm*—Rankin, Hill, Porter & Clark LLP

(57) ABSTRACT

A piezoelectric acoustic device capable of keeping a substantial diameter of a metal vibrating plate from being reduced and preventing clogging of a damping cloth member. The piezoelectric acoustic device includes a piezoelectric vibrator including a metal vibrating plate and a piezoelectric ceramic element joined to the metal vibrating plate. The piezoelectric vibrator is arranged in a casing which is formed on an inner peripheral surface thereof with an inclined joint surface section of an annular shape which surrounds an outer peripheral portion of the metal vibrating plate. The piezoelectric acoustic device also includes a pressure-sensitive adhesive layer formed by coating a pressure-sensitive adhesive on the inclined joint surface section. The outer peripheral portion of the metal vibrating plate is joined through the pressure-sensitive adhesive layer to the inclined joint surface section.

11 Claims, 7 Drawing Sheets

PIEZOELECTRIC ACOUSTIC DEVICE

BACKGROUND OF THE INVENTION

This invention relates to a piezoelectric acoustic device, and more particularly to a piezoelectric acoustic device in the form of a piezoelectric speaker, a piezoelectric buzzer or the like which is suitable for use for an electronic equipment such as a portable telephone or the like.

A piezoelectric acoustic device which has been conventionally known in the art is disclosed in U.S. Pat. No. 4,079,213 and U.S. Pat. No. 4,989,302. The conventional piezoelectric acoustic device disclosed includes a casing constituted of a combination of a first casing half and a second casing half, as well as a piezoelectric vibrator received in the casing. The piezoelectric vibrator includes a vibrating plate which is made of a metal material and has an outer peripheral portion interposedly held between the first casing half and the second casing half. Another piezoelectric acoustic device is also proposed which is constructed in substantially the same manner as that described above except that a vibrating plate is joined at an outer peripheral portion thereof to a casing by means of an adhesive.

Unfortunately, the adhesive before curing is pasty and exhibits flowability or fluidity, resulting in flowing on a metal vibrating plate while spreading inwardly in a radial direction thereof. Thus, after the adhesive is cured, it deteriorates vibration of the outer peripheral portion of the metal vibrating plate, to thereby reduce a substantial diameter of the metal vibrating plate. For example, when the adhesive spreads by 0.5 mm inwardly in the radial direction of the metal vibrating plate, the metal vibrating plate is reduced by about 1.0 mm in substantial diameter thereof.

SUMMARY OF THE INVENTION

The present invention has been made in view of the foregoing disadvantage of the prior art.

Accordingly, it is an object of the present invention to provide a piezoelectric acoustic device which is capable of keeping a substantial diameter of a metal vibrating plate from being reduced.

It is another object of the present invention to provide a piezoelectric acoustic device which is capable of preventing clogging of a damping cloth member.

It is a further object of the present invention to provide a piezoelectric acoustic device which is capable of eliminating a necessity of arranging a damping cloth member as required.

In accordance with the present invention, a piezoelectric acoustic device is provided. The piezoelectric acoustic device includes a piezoelectric vibrator including a metal vibrating plate and a piezoelectric ceramic element joined to the metal vibrating plate, a casing constructed so as to receive the piezoelectric vibrator therein and formed on an inner peripheral surface thereof with an inclined joint surface section of an annular shape which surrounds an outer peripheral portion of the metal vibrating plate, and a pressure-sensitive adhesive layer formed by coating a pressure-sensitive adhesive on the inclined joint surface section. The outer peripheral portion of the metal vibrating plate is joined through the pressure-sensitive adhesive layer to the inclined joint surface section.

The term "pressure-sensitive adhesive" used herein means an adhesive which is made by dissolving a sticky or tacky material in a solvent or made of the sticky or tacky material. Also, the term "pressure-sensitive adhesive layer" used herein indicates a layer which is formed by volatilizing the solvent from the pressure-sensitive adhesive or is formed of the sticky material. The pressure-sensitive adhesive layer exhibits stickiness even when it does not contain the solvent or even when it is in a dry state, which stickiness permits joining between the outer peripheral portion of the metal vibrating plate and the inclined joint surface section. More particularly, joining between members by means of a pressure-sensitive adhesive is generally carried out by volatilizing a solvent contained in the pressure-sensitive adhesive therefrom and then subjecting the members to joining while abutting them against to each other. Thus, joining using a pressure-sensitive adhesive is distinguished from that using a curable adhesive wherein members to be joined are abutted against each other prior to drying (curing) of the curable adhesive. The pressure-sensitive adhesive suitable for use in the present invention may be prepared by dissolving a sticky material mainly consisting of acrylic resin, synthetic rubber or the like in a solvent such as toluene, ethyl acetate or the like.

The pressure-sensitive adhesive layer formed on the inclined joint surface section does not exhibit flowability or fluidity which causes the pressure-sensitive adhesive layer to radially inwardly enlarge or expand on the metal vibrating plate, unlike a paste-like curable adhesive. Also, the pressure-sensitive adhesive layer permits the metal vibrating plate to be joined to the casing while biting corners of the outer peripheral portion of the metal vibrating plate arranged at a predetermined angle on the inclined joint surface section of the casing into the pressure-sensitive adhesive layer, resulting in reducing a contact area between the outer peripheral portion of the metal vibrating plate and the pressure-sensitive adhesive layer. Also, the pressure-sensitive adhesive layer exhibits flexibility unlike a curable adhesive layer, to thereby ensure satisfactory vibration of the metal vibrating plate. Thus, the present invention prevents a reduction in substantial diameter of the metal vibrating plate.

The casing may be constituted of a first casing half made of an insulating resin material and including a first opposite wall arranged opposite to one surface of the piezoelectric vibrator and a first peripheral wall arranged so as to extend from an outer peripheral portion of the first opposite wall and a second casing half including a second opposite wall arranged opposite to the other surface of the piezoelectric vibrator and a second peripheral wall arranged so as to extend from an outer peripheral portion of the second opposite wall and fitted to the first peripheral wall of the first casing half. In this instance, the first peripheral wall and second peripheral wall are formed on an inner peripheral surface thereof with a first tapered surface section and a second tapered surface section, respectively. The first and second tapered surface sections cooperate with each other to form an annular groove for fitting the outer peripheral portion of the metal vibrating plate therein when the first and second peripheral walls are fitted to each other. The first and second tapered surface sections each are inclined so as to permit the groove to enlarge toward a central portion of the casing while directing an opening of the groove toward the central portion. One of the first and second tapered surface sections acts as the inclined joint surface section. The pressure-sensitive adhesive is coated on the inner peripheral surface of the first peripheral wall, to thereby provide the pressure-sensitive adhesive layer. The outer peripheral portion of the metal vibrating plate is held in the casing by means of a portion of the pressure-sensitive adhesive layer positioned in the groove.

In the illustrated embodiment, the first peripheral wall has an opposite surface constituting a part of an inner peripheral surface thereof and arranged opposite to an outer peripheral surface of the second peripheral wall. The opposite surface of the first peripheral wall and the outer peripheral surface of the second peripheral wall are so configured that the opposite surface is positioned outside a virtual surface defined by a locus of a distal end of the outer peripheral surface of the second peripheral wall when the first peripheral wall and second peripheral wall are fitted to each other and the pressure-sensitive adhesive layer applied to the opposite surface is prevented from being intruded into the groove.

Formation of the opposite surface of the first peripheral wall and the outer peripheral surface of the second peripheral wall into the above-described configuration permits fitting between the first peripheral wall and the second peripheral wall while keeping the distal end of the second peripheral wall from being abutted against the opposite surface of the first peripheral wall, resulting in minimizing the amount of pressure-sensitive adhesive forced out to the groove by the distal end of the second peripheral wall. This substantially restrains the pressure-sensitive adhesive forced out to the groove from being adhered to the metal vibrating plate, to thereby prevent a reduction in substantial diameter of the metal vibrating plate.

BRIEF SUMMARY OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a piezoelectric acoustic device according to the present invention will be described with reference to the accompanying drawings.

Figure 1:
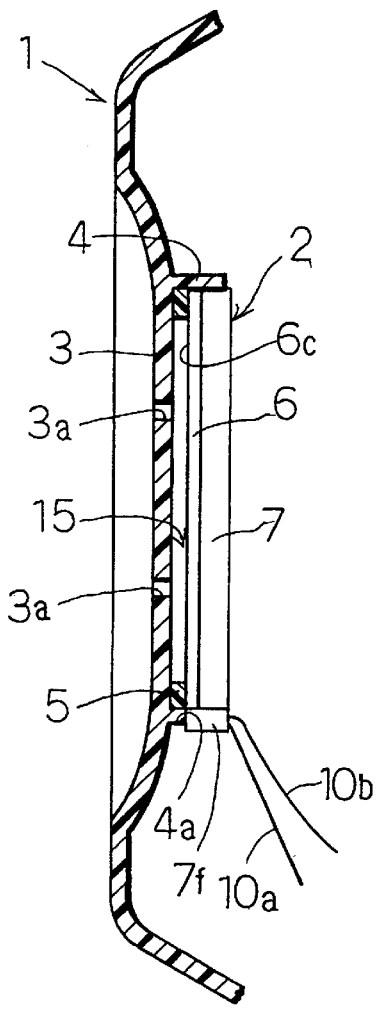
FIG. 1 is a schematic fragmentary sectional view showing a receiver of a portable telephone in which an embodiment of a piezoelectric acoustic device according to the present invention is incorporated by way of example.
Figure 2:
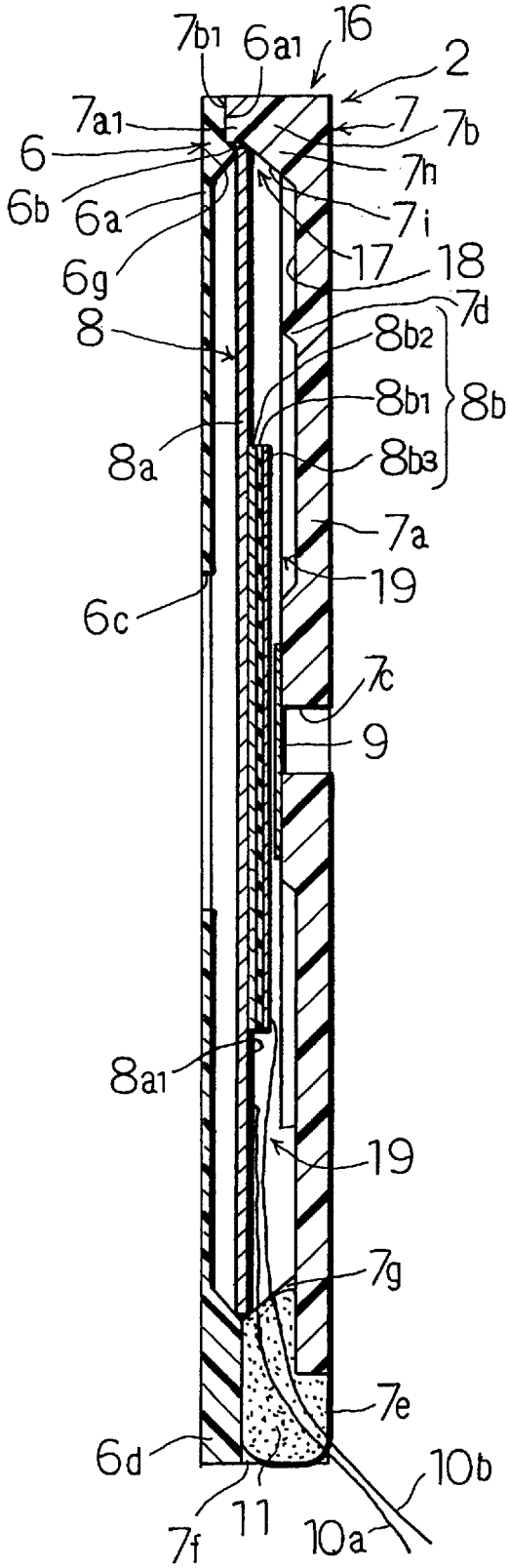
FIG. 2 is a schematic sectional view of the piezoelectric acoustic device shown in FIG. 1.

Referring first to FIGS. 1 and 2, an embodiment of a piezoelectric acoustic device according to the present invention is illustrated, wherein FIG. 1 shows an electronic equipment in the form of a receiver of a portable telephone in which a piezoelectric acoustic device of the illustrated embodiment is incorporated and FIG. 2 schematically shows the piezoelectric acoustic device of FIG. 1. In FIG. 2, a thickness of each of parts is emphasized for the purpose of facilitating understanding of the illustrated embodiment.

The telephone receiver, as shown in FIG. 1, includes a housing 1, in which the piezoelectric acoustic device of the illustrated embodiment generally designated at reference numeral 2 is arranged. The housing 1 includes a housing body 3, which is integrally provided on an inner surface thereof with a projection 4 acting as a fit section in which the piezoelectric acoustic device 2 is fittedly mounted. The projection 4 is formed into a cylindrical shape and provided with a cutout-like recess 4*a* and correspondingly the piezoelectric acoustic device 2 is provided thereon with a pair of positioning projection halves 7*f*, which are adapted to be fitted in the recess 4*a* of the projection 4. The housing body 3 is formed at a portion thereof surrounded by the cylindrical projection 4 with at least one sound discharge hole 3*a*. The cylindrical projection 4 has a ring-like spacer 5 arranged on an inner peripheral surface thereof in a manner to extend in a circumferential direction thereof. Thus, the projection 4 is fitted therein with an end of the piezoelectric acoustic device 2 through the ring-like spacer 5 when the positioning projection halves 7*f* of the piezoelectric acoustic device 2 are fitted in the cutout-like recess 4*a*. More specifically, the piezoelectric acoustic device 2 is fitted in the projection 4 so that an opening 6*c* of a front casing half 6 is rendered opposite to the sound discharge hole 3*a* or covered with a wall of the housing body 3. This permits a front air chamber 15 to be defined between the wall of the housing body 3 and a piezoelectric vibrator 8 of the piezoelectric acoustic device 2.

The piezoelectric acoustic device 2, as shown in FIG. 2, includes a split or two-part insulating casing 16 constituted of a combination of the front casing half 6 briefly described above which constitutes a first casing half and a rear casing half 7 constituting a second casing half, which casing halves 6 and 7 are fittedly connected to each other. The casing 16 is provided therein with the piezoelectric vibrator 8, which is constructed so as to vibrate depending on an electrical signal. The front casing half 6 includes a first opposite wall 6*a* of a disc-like shape arranged opposite to a front surface of the piezoelectric vibrator 8 and a first peripheral wall 6*b* of a substantially annular shape inwardly arranged so as to extend from an outer periphery of the first opposite wall 6*a*, to thereby leave an annular peripheral edge 6*a*1 on the first opposite wall 6*a*. The front casing half 6 is integrally formed of an insulating resin material which may be PPO resin having glass added thereto. The first opposite wall 6*a* is formed with a front opening 6*c* of a circular shape through which a metal vibrating plate 8*a* of the piezoelectric vibrator 8 is exposed. Also, the first opposite wall 6*a* is integrally provided on the outer periphery thereof with a positioning projection half 6*d* of a parallelopiped shape. The first peripheral wall 6*b* is formed on an inner peripheral surface thereof with an inclined surface section or a first tapered surface section 6*g*. The first tapered surface section 6*g* is formed so as to enlarge outwardly in a radial direction of the piezoelectric vibrator 8 with an increase in distance by which the first tapered surface section 6*g* is separated from the front opening 6*c*.

The rear casing half 7 constituting the second casing half includes a second opposite wall 7*a* of a disc-like shape and a second peripheral wall 7*b* arranged so as to inwardly extend from an outer peripheral portion of the second opposite wall 7*a*. The rear casing half 7 is integrally formed of an insulating resin material which may be PPO resin having glass added thereto. The second opposite wall 7*a* is formed with a rear opening 7*c* constituting a leakage hole. The rear opening 7*c* is arranged at a central portion of the second opposite wall 7*a* and the second opposite wall 7*a* has a damping cloth member 9 joined or adhered to an inner surface thereof so as to cover the rear opening 7*c*. The manner of joint or adhesion of the damping cloth member 9 to the second opposite wall 7*a* will be described hereinafter. The second opposite wall 7*a* is formed on an inner surface thereof opposite to the front casing half 6 with a reinforcing rib 7*d*. The reinforcing rib 7*b* is formed into a lattice-like shape, as well as into a configuration and dimensions sufficient to increase strength of the rear casing half 7. The second peripheral wall 7*b* is formed into a substantially annular configuration while being provided with a cutout 7*g*, through which lead wires 10*a* and 10*b* are led out of the rear casing half 7. Also, the rear casing member 7 is integrally provided with a plate-like section 7*e* in a manner to be adjacent to the cutout 7*g*. The plate-like section 7*e* is integrally provided on both surfaces thereof with the above-described projection halves 7*f*, between which the projection half 6*d* is interposedly arranged. The cutout 7*g* is filled therein with a sealing agent 11 which may be a silicone rubber adhesive. The second peripheral wall 7*b* is integrally provided on an inner surface thereof with an annular rib 7*h*. The rib 7*h* is formed on an inner peripheral surface thereof with a second tapered surface section 7*i*. The second tapered surface section 7*i* is formed so as to enlarge outwardly in the radial direction of the piezoelectric vibrator 8 as a distance by which the second tapered surface section 7*i* is separated from the rear opening 7*c* is increased, as in the first tapered surface section 6*g* of the front casing half 6.

The front casing half 6 and rear casing half 7 are fitted at the peripheral walls 6*b* and 7*b* thereof to each other while contacting an end surface 7*b*1 of the second peripheral wall 7*b* of the rear casing half 7 with the peripheral edge 6*a*1 of the front casing half 6, resulting in providing the casing 16. The end surface 7*b*1 of the rear casing half 7 and the peripheral edge 6*a*1 of the front casing half 6 are sealedly joined to each other by welding or the like, to thereby prevent leakage of air from a fit section between the front casing half 6 and the rear casing half 7. Fitting between the peripheral wall 6*b* of the front casing half 6 and the peripheral wall 7*b* of the rear casing half 7 permits the first tapered surface section 6*g* and second tapered surface section 7*i* to cooperate with each other to provide a groove 17 on an inner peripheral surface of the casing 16. The groove 17 thus provided is arranged so as to spread or enlarge toward a center of the casing 16 while being directed toward the center, resulting in being formed into a substantially V-shape in cross section in which an outer peripheral portion of the metal vibrating plate 8*a* is received.

The piezoelectric vibrator 8 includes the above-described metal vibrating plate 8*a* and a piezoelectric ceramic element 8*b* arranged on the metal vibrating plate 8*a* so as to leave a first electrode section 8*a*1 on an outer peripheral portion of the metal vibrating plate 8*a*. In the illustrated embodiment, the metal vibrating plate 8*a* is made of Fe—Ni alloy and formed into a circular shape having a diameter of 14 mm and a thickness of 50 μm. The piezoelectric ceramic element 8*b* includes a piezoelectric ceramic member 8*b*1, as well as a joint electrode layer 8*b*2 and a non-joint electrode layer 8*b*3 arranged on both surfaces of the piezoelectric ceramic member 8*b*1. The joint electrode layer 8*b*2 is arranged so as to be electrically connected to the metal vibrating plate 8*a*. The first electrode section 8*a*1 and non-joint electrode layer 8*b*3 have the lead wires 10*a* and 10*b* connected thereto by soldering, respectively, so that the piezoelectric vibrator 8 may vibrate depending on an electrical signal fed between the first electrode section 8*a*1 and the non-joint electrode layer 8*b*3.

Figure 3:
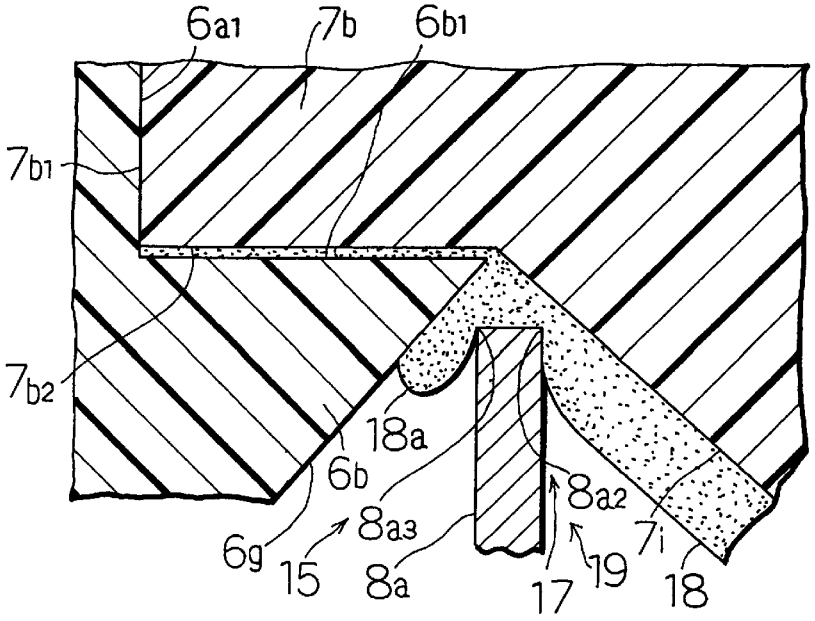
FIG. 3 is a fragmentary enlarged sectional view showing fixing between a piezoelectric vibrator and first and second tapered sections in the piezoelectric acoustic device shown in FIG. 2.
Figure 4:
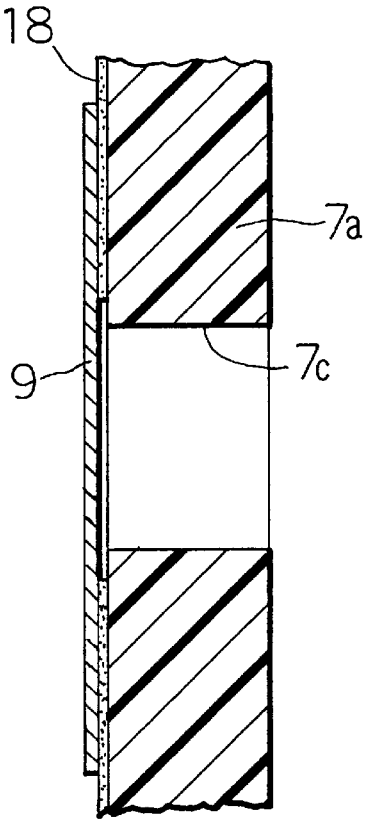
FIG. 4 is a fragmentary enlarged sectional view showing a joint between a damping cloth member and a rear casing half in the piezoelectric acoustic device shown in FIG. 2.
Figure 6:
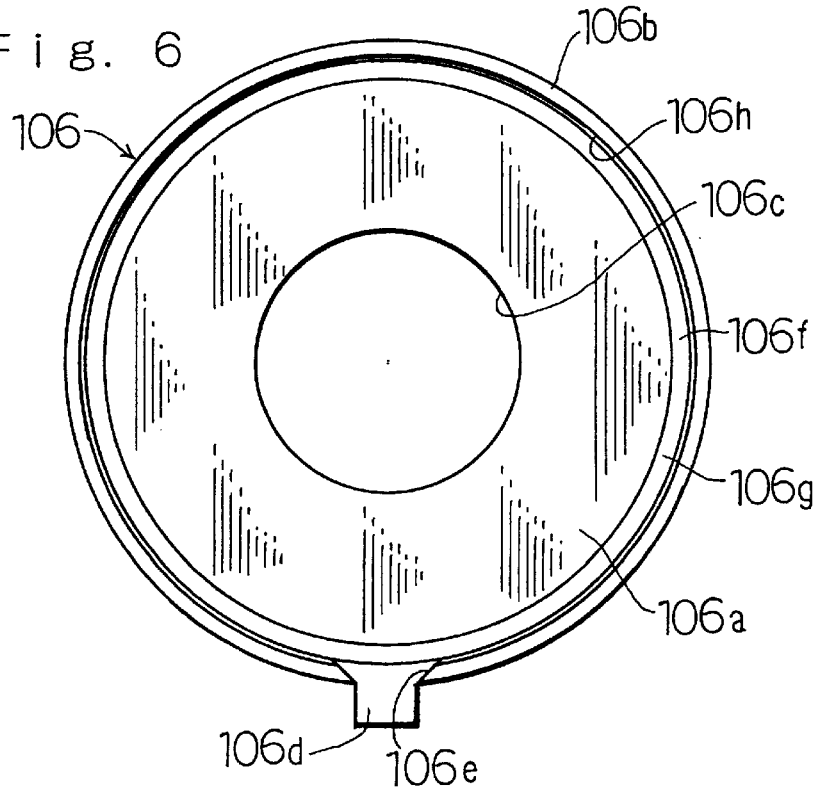
FIG. 6 is a plan view showing a front casing half incorporated in the piezoelectric acoustic device of FIG. 5.
Figure 5:
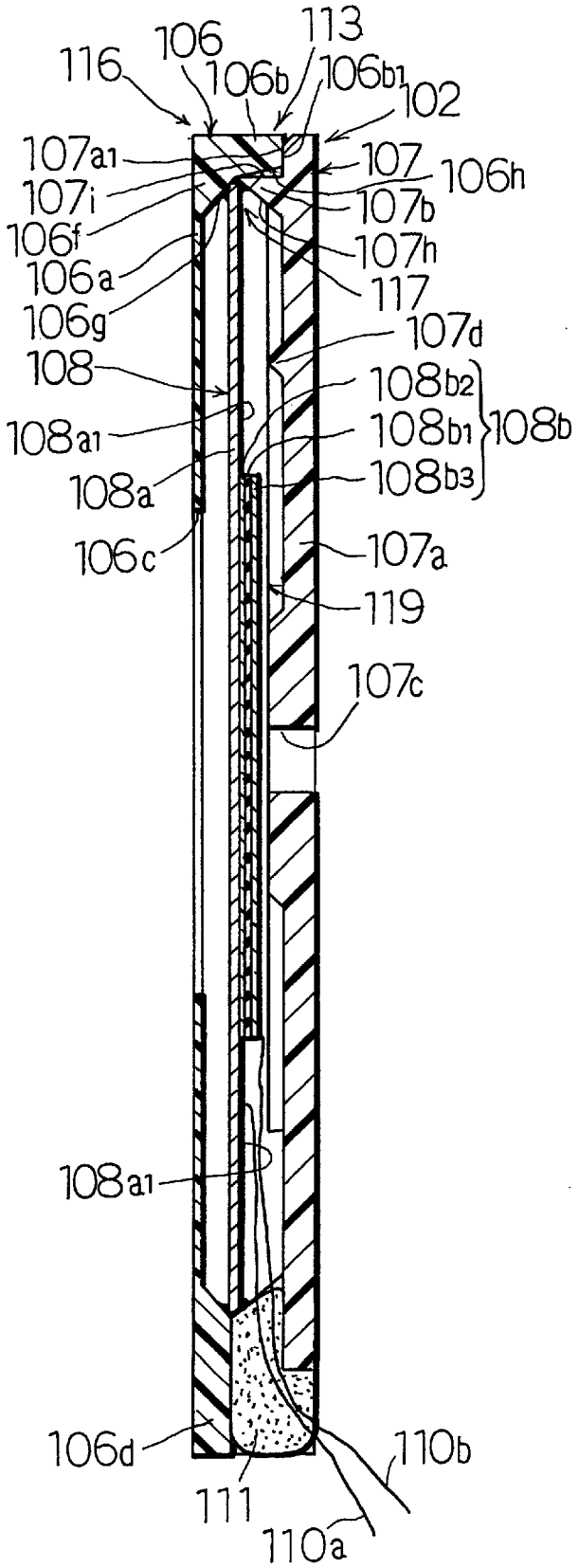
FIG. 5 is a schematic sectional view showing another embodiment of a piezoelectric acoustic device according to the present invention.
Figure 7:
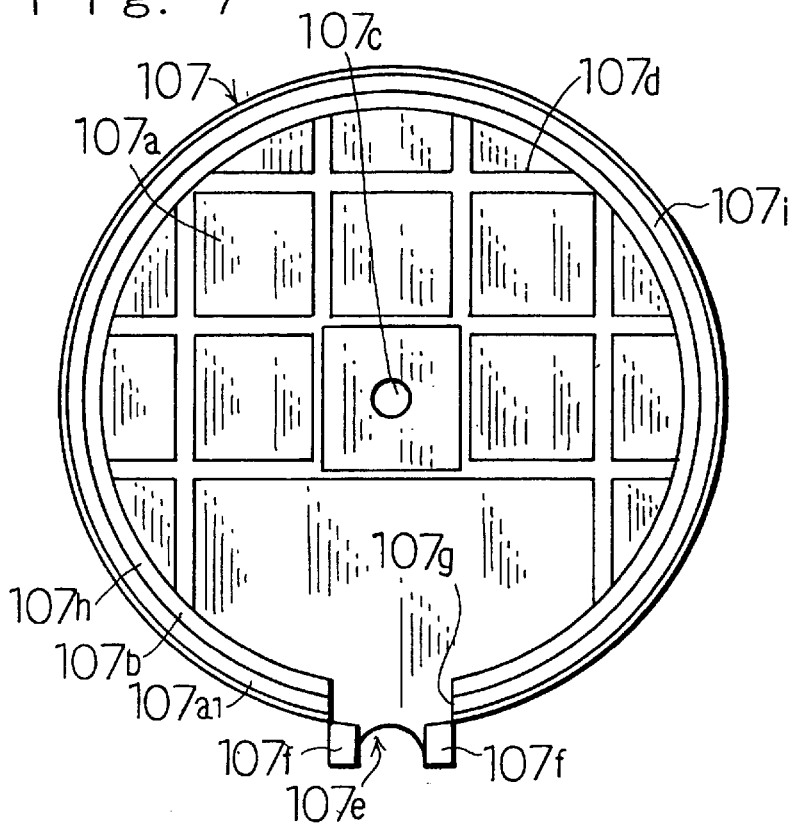
FIG. 7 is a plan view showing a rear casing half incorporated in the piezoelectric acoustic device of FIG. 5.

Joining between the outer peripheral portion of the metal vibrating plate 8*a* and the first and second tapered surface sections 6*g* and 7*i* may be carried out as shown in FIG. 3. More specifically, the metal vibrating plate 8*a* is received at the outer peripheral portion thereof in the groove 17 in a manner to be interposedly held therein. Also, the metal vibrating plate 8*a* is joined at the outer peripheral portion thereof to the casing 16 through a pressure-sensitive adhesive layer 18 formed on the second tapered surface section 7*i* of the second peripheral wall 7*b*. The pressure-sensitive adhesive layer 18 may be formed by dissolving a pressure-sensitive adhesive mainly consisting of acrylic resin in a suitable solvent such as toluene or the like to prepare an adhesive solution and then volatilizing the solvent from the solution. The solvent may be used in an amount of 40 to 50% by weight. In the illustrated embodiment, the pressure-sensitive adhesive layer 18 may be suitably formed of a solvent volatilization type pressure adhesive commercially available under a tradename "CT-1300" from CEMEDINE CO., LTD., a Japanese corporation, into a thickness of 100 μm or less. Such a thickness of the pressure-sensitive adhesive layer 18 effectively prevents a reduction in substantial diameter of the metal vibrating plate 8*a*. The pressure-sensitive adhesive layer 18 is arranged so as to extend from a gap between an outer peripheral surface 6*b*1 of the first peripheral wall 6*b* of the front casing half 6 and an inner peripheral surface 7*b*2 of the second peripheral wall 7*b* of the rear casing half 7 through the second tapered surface section 7*i* contiguous to the inner peripheral surface 7*b*2 to a portion of the second opposite wall 7*a* in proximity to the rear opening 7*c*, as shown in FIGS. 2 to 4. The metal vibrating plate 8*a* is held at the outer peripheral portion thereof through the pressure-sensitive adhesive layer 18 in the groove 17 of the casing 16 while keeping corners 8*a*2 and 8*a*3 of the outer peripheral portion of the metal vibrating plate 8*a* embedded in the pressure-sensitive adhesive layer 18 without being abutted against the second and first tapered surface sections 7*i* and 6*g*. In the illustrated embodiment, arrangement of the metal vibrating plate 8*a* in the front and rear casing halves 6 and 7 is carried out in such a manner that the metal vibrating plate 8*a* is joined at the outer peripheral portion thereof to the pressure-sensitive adhesive layer 18 on the second tapered surface section 7*i* and then fitting between the second peripheral wall 7*b* of the rear casing half 7 and the first peripheral wall 6*b* of the rear casing half 6 is carried out. Such arrangement permits the pressure-sensitive adhesive layer 18 to be partially forced out to a gap between the metal vibrating plate 8*a* and the first tapered surface section 6*g* as indicated at reference character 18*a*. In the illustrated embodiment, the second tapered surface section 7*i* of the rear casing half 7 constitutes an annular inclined joint surface section to which the metal vibrating plate 8*a* is joined. The pressure-sensitive adhesive layer 18 exhibits non-flowability or non-fluidity due to the above-described volatilization, as well as increased flexibility, resulting in permitting displacement of the outer peripheral portion of the metal vibrating plate 8*a*. Also, the metal vibrating plate 8*a* is intruded at the outer peripheral portion thereof into the flexible pressure-sensitive adhesive layer 18 without being abutted against the first and second tapered surface sections 6*g* and 7*i*, resulting in being readily moved. This effectively restrains a reduction in substantial diameter of the metal vibrating plate 8*a*. Also, the outer peripheral portion of the metal vibrating plate 8*a* is joined through the pressure-sensitive adhesive layer 18 to the second tapered surface section 7*i*, so that a rear air chamber 19 may be defined on a side of the metal vibrating plate 8*a* facing the rear casing half 7 while being kept from communicating with the front air chamber 19.

The above-described construction of the illustrated embodiment permits the pressure-sensitive adhesive layer 18*a* in a slight amount which is a part of the pressure-sensitive adhesive layer 18 to be present at the gap of a minute size (micro-gap) between the first tapered surface section 6*g* and the metal vibrating plate 8*a*. Presence of the pressure-sensitive adhesive layer 18*a* in the micro-gap tends to restrain displacement of the outer peripheral portion of the metal vibrating plate 8*a*, in spite of the fact that the pressure-sensitive adhesive layer 18 exhibits increased flexibility. Thus, a thickness of the pressure-sensitive adhesive layer 18 and an angle of inclination of the first and second tapered surface sections 6*g* and 7*i* each are desirably set to a degree sufficient to prevent the pressure-sensitive adhesive layer 18*a* from entering the micro-gap. It is a matter of course that the micro-gap defined between the first tapered surface section 6*g* and the metal vibrating plate 8*a* is formed into dimensions which prevent the outer peripheral portion of the metal vibrating plate 8*a* vibrating from being peeled off from the pressure-sensitive adhesive layer 18 when external shock or vibration is applied thereto.

The pressure-sensitive adhesive layer 18, as shown in FIG. 4, is formed by applying the pressure-sensitive adhesive to a portion of the second opposite wall 7*a* positioned in the vicinity of the rear opening 7*c*. Such arrangement of the pressure-sensitive adhesive layer 18 prevents the pressure-sensitive adhesive from entering the rear opening 7*c*. In the illustrated embodiment, the pressure-sensitive adhesive layer 18 is arranged so as to also act to join a damping cloth member 9 made of a woven fabric of polyester or the like to the inner surface of the second opposite wall 7*a* so that the damping cloth member 9 may cover the rear opening 7*c*. This permits the single pressure-sensitive adhesive layer 18 to join both metal vibrating plate 8*a* and damping cloth member 9 to the second casing half 7 of the casing 16. Such joining of the damping cloth member 9 to the second casing half 7 of the casing by means of the pressure-sensitive adhesive layer 18 effectively prevents the damping cloth member 9 from being clogged with the pressure-sensitive adhesive.

Now, manufacturing of the piezoelectric acoustic device of the illustrated embodiment will be described hereinafter.

First, the pressure-sensitive adhesive is coated on the inner surface of the rear casing member 7 extending from the inner peripheral surface 7*b*2 through the second tapered surface section 7*i* to the portion of the second opposite wall 7*a* positioned in proximity to the rear opening 7*c* by means of automatic coating machine. Then, the pressure-sensitive adhesive is heated at about 100° C. for 5 to 10 minutes to volatilize toluene, resulting in being dried, leading to formation of the pressure-sensitive adhesive layer 18. Such drying of the pressure-sensitive adhesive permits cross-linking of the adhesive to be carried out concurrently with volatilization of toluene. Then, the damping cloth member 9 is stuck to the inner surface of the second opposite wall 7*a* by adhesive force of the pressure-sensitive adhesive layer 18. Thereafter, the metal vibrating plate 8*a* of the piezoelectric vibrator 8 is forcedly pressed onto the pressure-sensitive adhesive layer 18 formed on the second tapered surface section 7*i*. Then, the second peripheral wall 7*b* of the rear casing half 7 and the first peripheral wall 6*b* of the front casing half 6 are fitted to each other, followed by joining between the end surface 7*b*1 of the rear casing half 7 and the annular peripheral edge 6*a*1 of the front casing half 6 by welding.

It is merely required that the pressure-sensitive adhesive layer 18 is formed on at least the inclined joint surface section or, in the illustrated embodiment, the second tapered surface section. Thus, the pressure-sensitive adhesive layer 18 may be formed into any desired dimensions and configuration. Also, in the illustrated embodiment, as described above, the inclined joint surface section is constituted by the second tapered surface section 7*i* of the second peripheral wall 7*b*. Alternatively, the illustrated embodiment may be so constructed that the pressure-sensitive adhesive is applied to the first tapered surface section 6*g* of the first peripheral wall 6*b*, resulting in the inclined joint surface section being constituted by the first tapered surface section 6*g*.

Referring now to FIGS. 5 to 8, another embodiment of a piezoelectric acoustic device according to the present invention is illustrated. A piezoelectric acoustic device of the illustrated embodiment is constructed in substantially the same manner as that of the embodiment described above with reference to FIGS. 2 and 3, except a first peripheral wall of a front casing half and a second peripheral wall of a rear casing half, as well as absence of a damping cloth member at a rear opening. Thus, in connection with the illustrated embodiment, reference numerals correspond to the reference numerals discussed above, except with an additional prefix of 100.

The piezoelectric acoustic device of the illustrated embodiment generally designated at reference numeral 102 is different from that shown in FIGS. 2 and 3 in that a first casing half or front casing half 106 and a second casing half or rear casing half 107 are constructed so as to permit a second peripheral wall 107*b* to be fitted in a first peripheral wall 106*b*. The first peripheral wall 106*b* of the front casing half 106 is integrally provided on an inside thereof with an annular rib 106*f*. The rib 106*f* is formed on an inner surface thereof with a first tapered surface section 106*g*. The first tapered surface section 106*g* constitutes an inclined joint surface section and is inclined so as to spread or enlarge outwardly in a radial direction of a piezoelectric vibrator 108 with an increase in distance by which the first tapered surface section 106*g* is separated from a front opening 106*c* of the front casing half 106. The first peripheral wall 106*b* has an opposite surface 106*h* constituting a part of an inner peripheral surface thereof and arranged opposite to an outer peripheral surface of the second peripheral wall 107*b*. The opposite surface 106*h* of the first peripheral wall 106*b* is likewise formed in a manner to be inclined so as to spread or enlarge outwardly in the radial direction of the piezoelectric vibrator 108 with an increase in distance by which the opposite surface 106*h* is separated from the front opening 106*c*. The opposite surface 106*h* will be more detailedly described hereinafter.

The peripheral wall 107*b* of the rear casing half 107 is arranged so as to extend from a second opposite wall 107*a* to the first casing half 106 while being raised from the second opposite wall 107*a*, to thereby leave an edge 107*a*1 on the second opposite wall 107*a*. The peripheral wall 107*b* is formed on an inner peripheral surface thereof with a second tapered surface section 107*h*. The second tapered surface section 107*h* is formed in a manner to be inclined so as to enlarge outwardly in the radial direction of the piezoelectric vibrator 108 with an increase in distance by which the second tapered surface section 107*h* is separated from a rear opening 107*c*, as in the first tapered surface section 106*g*. The second peripheral wall 107*h* has an outer peripheral surface 107*i* arranged opposite to the opposite surface 106*h* constituting a part of the inner peripheral surface of the first peripheral wall 106*b*. The outer peripheral surface 107*i* of the second peripheral wall 107*b* is formed so as to extend in a direction perpendicular to the piezoelectric vibrator 108.

Figure 8:
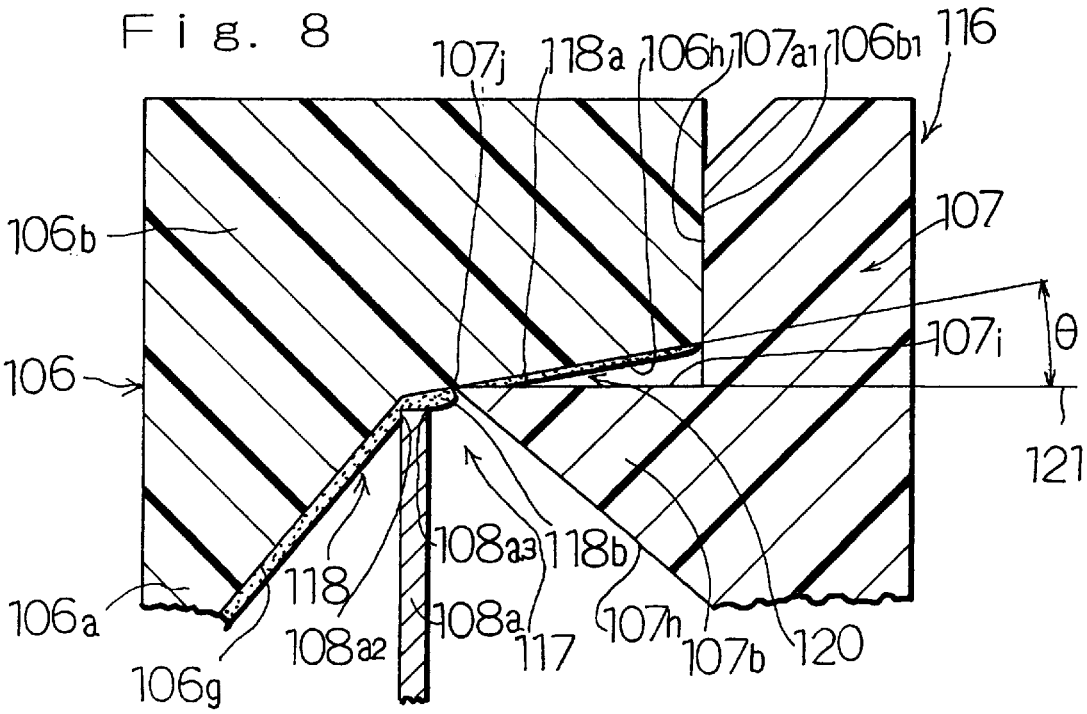
FIG. 8 is a fragmentary enlarged sectional view showing fixing between a piezoelectric vibrator and first and second tapered sections in the piezoelectric acoustic device shown in FIG. 5.

A casing 116, as shown in FIG. 8, is provided therein with a groove 117 of a substantially V-shape in cross section, which is defined by a combination of the first tapered surface section 106*g* and second tapered surface section 107*h*. A metal vibrating plate 108*a* is interposedly fitted at an outer peripheral portion thereof in the groove 117. Also, the metal vibrating plate 108*a* is joined at the outer peripheral portion thereof to the first tapered surface section 106*g* through a pressure-sensitive adhesive layer 118 formed on an inner peripheral surface of the first peripheral wall 106*b*. Thus, the outer peripheral portion of the metal vibrating plate 108*a* is held in the groove 117 of the casing 116 through the pressure-sensitive adhesive layer 118 while being embedded in the pressure-sensitive adhesive layer 118 without causing the outer peripheral portion to be abutted at corners 108*a*2 and 108*a*3 thereof against the first and second tapered surface sections 106*g* and 107*h*. Also, the opposite surface 106*h* of the first peripheral wall 106*b* is so inclined that a gap between the opposite surface 106*h* of the first peripheral wall 106*b* and the outer peripheral surface 107*i* of the second peripheral wall 107*b* is increased with an increase in distance by which the opposite surface 106*h* is separated from the first opposite wall 106*a*. In the illustrated embodiment, an angle θ at which the opposite surface 106*h* and outer peripheral surface 107*i* intersect each other is set to be 15 degrees, resulting in a gap 120 being defined therebetween. The opposite surface 106*h* and outer peripheral surface 107*i* may be so arranged that the angle θ is between 10 degrees and 25 degrees. Such arrangement of the opposite surface 106*h* and outer peripheral surface 107*i* causes a pressure-sensitive adhesive layer 118*a* to remain in the gap 120 without being forced into the groove 117, when the first peripheral wall 106*b* and second peripheral wall 107*b* are fitted to each other. The remaining part of the illustrated embodiment may be constructed in substantially the same manner as the embodiment described above with reference to FIGS. 2 and 3.

Now, manufacturing of the piezoelectric acoustic device 102 of the illustrated embodiment will be described hereinafter.

First of all, the first tapered surface section 106*g* constituting the inner peripheral surface of the first peripheral wall 106*b* and the opposite surface 106*h* are coated thereon with the pressure-sensitive adhesive by means of an automatic coating machine. Then, the pressure-sensitive adhesive is heated at a temperature of about 100° C. for 5 to 10 minutes. This permits toluene contained in the adhesive to be volatilized, to thereby form the pressure-sensitive adhesive layer 118. Such drying of the pressure-sensitive adhesive by heating accomplishes cross-linking of the adhesive as well as volatilization of toluene. Then, the metal vibrating plate 108*a* of the piezoelectric vibrator 108 is forcedly pressed onto the pressure-sensitive adhesive layer 118 formed on the first tapered surface section 106*g*. Subsequently, the second peripheral wall 107*b* of the rear casing half 107 is fitted in the first peripheral wall 106*b* of the front casing half 106, followed by joining between an end surface 106*b*1 of the front casing half 106 and the edge 107*a*1 of the rear casing half 107 by welding, resulting in the piezoelectric acoustic device 102 of the illustrated embodiment being finished.

In the illustrated embodiment, the opposite surface 106*h* and outer peripheral surface 107*i* are arranged in a manner to intersect each other at an angle of 15 degrees so that the opposite surface 106*h* is positioned outside a virtual surface 121 defined by a locus of a distal end 107*j* of the outer peripheral surface 107*i* of the second peripheral wall 107*b* of the second casing half 107 when the first peripheral wall 106*b* of the first casing half 106 and the second peripheral wall 107*b* of the second casing half 107 are fitted to each other. Such construction of the illustrated embodiment permits the first peripheral wall 106*b* and second peripheral wall 107*b* to be fitted to each other while keeping the distal end 107*j* of the second peripheral wall 107*b* from being abutted against the opposite surface 106*h* of the first peripheral wall 106*b*. Thus, the distal end 107*j* of the second peripheral wall 107*b* effectively restrains the pressure-sensitive adhesive adhered to the opposite surface 106*h* of the first peripheral wall 106*b* from being intruded into the groove 117, resulting in the pressure-sensitive adhesive substantially remaining in the gap 120. This minimizes the amount of a pressure-sensitive adhesive 118*b* forced into the groove 117, to thereby restrain a reduction in substantial diameter of the metal vibrating plate 108*a*.

Figure 9:
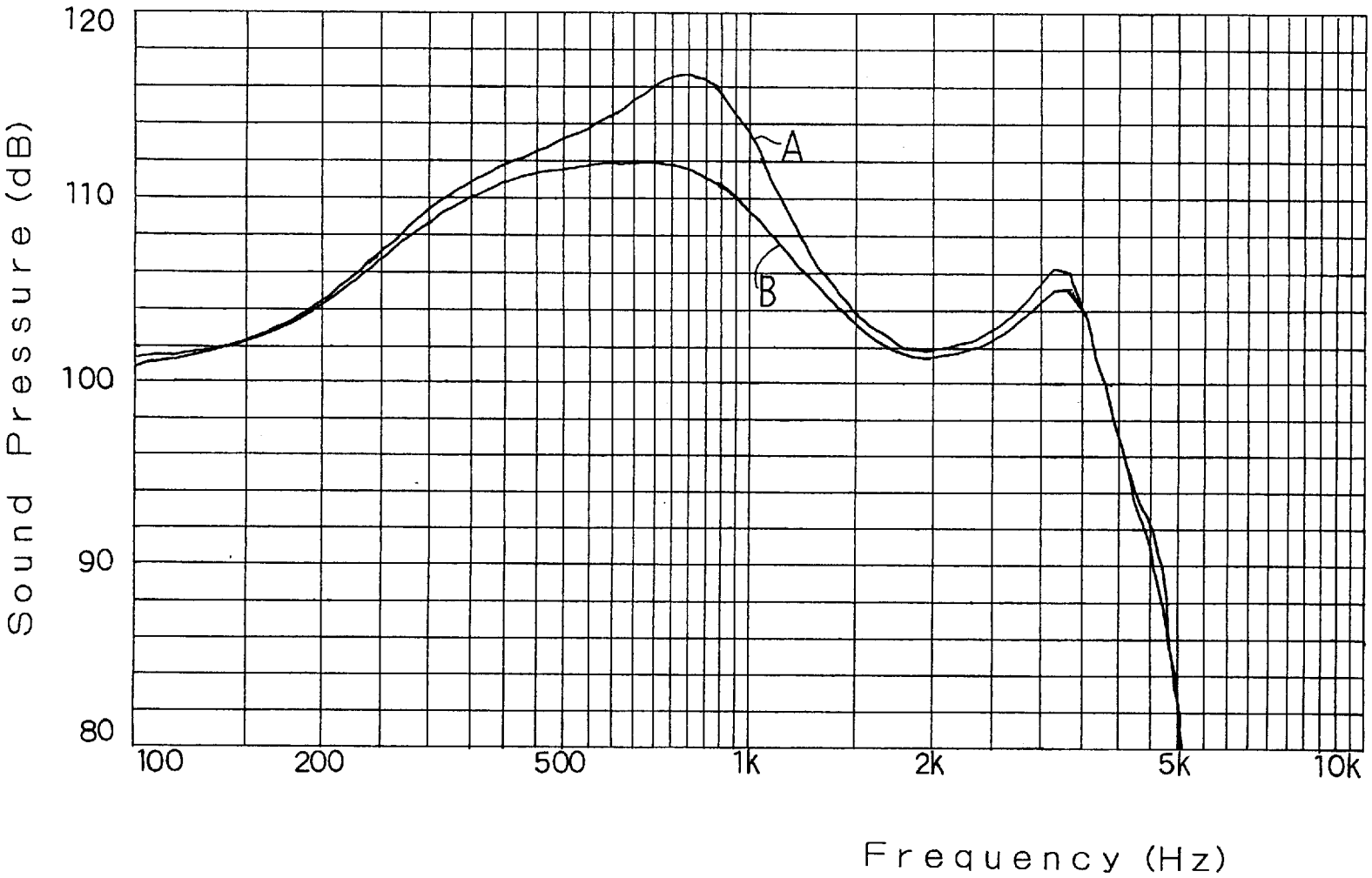
FIG. 9 is a graphical representation showing relationship between a frequency and a sound pressure in each of piezoelectric acoustic devices.
Figure 10:
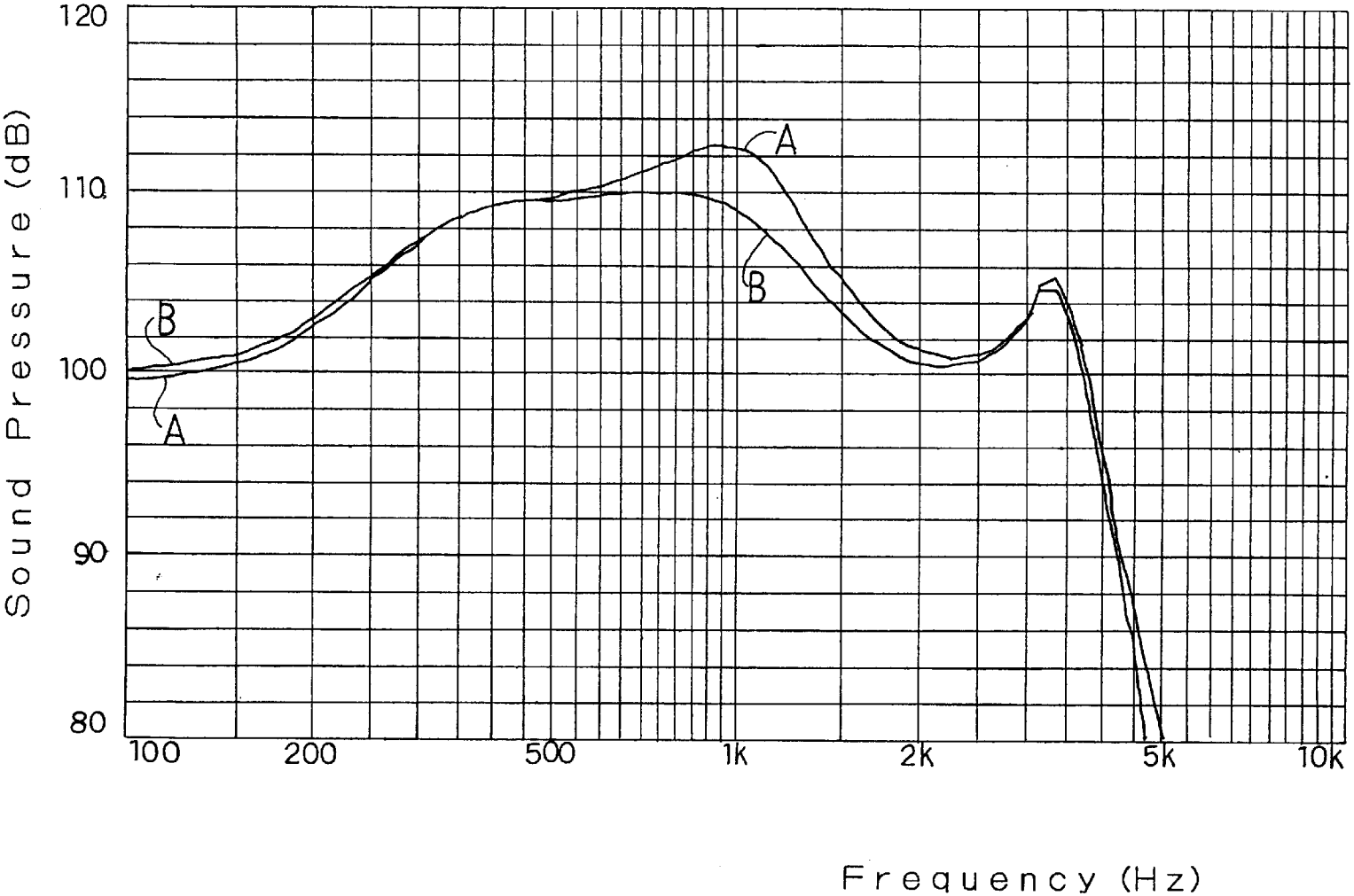
FIG. 10 is a graphical representation showing relationship between a frequency and a sound pressure in each of piezoelectric acoustic devices.

FIGS. 9 and 10 each show relationship between a frequency of each of various kinds of piezoelectric acoustic devices including the piezoelectric acoustic device of the illustrated embodiment or the device shown in FIG. 8 and a sound pressure thereof. In FIG. 9, a curve A indicates characteristics of the piezoelectric acoustic device of the illustrated embodiment wherein the vibrating plate is formed into a diameter of 14 mm and a curve B indicates characteristics of a piezoelectric acoustic device constructed in substantially the same manner as that of the illustrated embodiment except that a rear opening is closed with a damping cloth member. Also, in FIG. 10, a curve A indicates characteristics of a piezoelectric acoustic device constructed in substantially the same manner as that of the illustrated embodiment, except that an opposite surface of a first peripheral wall and an outer peripheral surface of a second peripheral wall are arranged so as to be substantially parallel to each other and more specifically intersect each other at an angle of 5 degrees. A curve B in FIG. 10 indicates characteristics of a piezoelectric acoustic device constructed in substantially the same manner as that of the illustrated embodiment, except that an opposite surface of a first peripheral wall and an outer peripheral surface of a second peripheral wall are arranged so as to be substantially parallel to each other and more specifically intersect each other at an angle of 5 degrees and a rear opening is closed with a damping cloth member. The piezoelectric acoustic device indicated at the curve A in FIG. 10 causes a frequency at a maximum sound pressure (peak sound pressure) to be as high as about 1 kHz, whereas the piezoelectric acoustic device of the illustrated embodiment of the curve A in FIG. 9 permits it to be as low as about 800 Hz which is substantially reduced as compared with 1 kHz. In general, it is considered that a portable telephone produces a relatively hearable voice by reducing a difference between a maximum sound pressure (peak sound pressure) and that at a frequency of about 500 Hz or reducing a frequency at a maximum sound pressure to a level of 1 kHz. Thus, such a conventional piezoelectric acoustic device as indicated at the curve A in FIG. 10 is constructed so as to close a rear opening with a damping cloth member to reduce a difference between a maximum sound pressure (peak sound pressure) and a sound pressure at a frequency of 500 Hz, resulting in producing a relatively hearable voice. On the contrary, the piezoelectric acoustic device of the illustrated embodiment indicated at the curve A in FIG. 9 permits a frequency at which a maximum sound pressure (peak sound pressure) is provided to be reduced to a level of about 800 Hz which is substantially low as compared with 1 kHz, although it causes a difference between the maximum sound pressure (peak sound pressure) and a sound pressure at a frequency of 500 Hz to be relatively increased. This permits the piezoelectric acoustic device of the illustrated embodiment to produce a relatively hearable voice while eliminating arrangement of the damping cloth member at the rear opening. Thus, it will be noted that in the piezoelectric acoustic device of the illustrated embodiment wherein the vibrating plate is formed into a diameter of about 14 mm, the opposite surface of the first peripheral wall and the outer peripheral surface of the second peripheral wall are configured so as to restrain the pressure-sensitive adhesive applied to the opposite surface from being intruded into the groove, resulting a relatively hearable voice being produced without the damping cloth member.

While preferred embodiments of the invention have been described with a certain degree of particularity with reference to the accompanying drawings, obvious modifications and variations are possible in light of the above teachings. It is therefore to be understood that within the scope of the appended claims, the invention may be practiced otherwise than as specifically described.

What is claim is:

1. A piezoelectric acoustic device comprising:

a piezoelectric vibrator including a metal vibrating plate and a piezoelectric ceramic element joined to said metal vibrating plate;

a casing constructed so as to receive said piezoelectric vibrator therein and formed on an inner peripheral surface thereof with an inclined joint surface section of an annular shape which surrounds an outer peripheral portion of said metal vibrating plate; and a pressure-sensitive adhesive layer formed by coating a pressure-sensitive adhesive on said inclined joint surface section;

said outer peripheral portion of said metal vibrating plate being joined through said pressure-sensitive adhesive layer to said inclined joint surface section.

2. A piezoelectric acoustic device as defined in claim 1, wherein said casing includes a first casing half made of an insulating resin material and including a first opposite wall arranged opposite to one surface of said piezoelectric vibrator and a first peripheral wall arranged so as to extend from an outer peripheral portion of said first opposite wall and a second casing half including a second opposite wall arranged opposite to the other surface of said piezoelectric vibrator and a second peripheral wall arranged so as to extend from an outer peripheral portion of said second opposite wall and fitted to said first peripheral wall of said first casing half;

one of said first and second casing halves being formed on an inner peripheral surface of said peripheral wall thereof with said inclined joint surface section;

said peripheral wall of the other of said first and second casing halves being formed into a configuration which prevents said metal vibrating plate from being peeled off from said pressure-sensitive adhesive layer due to application of external shock or vibration thereto.

3. A piezoelectric acoustic device as defined in claim 2, wherein said opposite wall of said one casing half is formed with an opening;

said pressure-sensitive adhesive layer formed on said inclined joint surface section of said one casing half is arranged so as to extend to a portion of said opposite wall of said one casing half positioned in proximity to said opening; and said opposite wall of said one casing half has a damping cloth member joined to an inner surface thereof through said pressure-sensitive adhesive layer so as to cover said opening.

4. A piezoelectric acoustic device as defined in claim 2 wherein said pressure-sensitive adhesive layer is formed into a thickness of 100 $\mu$m or less sufficient to prevent said metal vibrating plate from being contacted directly with said inclined joint surface section.

5. A piezoelectric acoustic device comprising:

a piezoelectric vibrator including a metal vibrating plate and a piezoelectric ceramic element joined to said metal vibrating plate;

a casing constructed so as to receive said piezoelectric vibrator therein and formed on an inner peripheral surface thereof with an inclined joint surface section of an annular shape which surrounds an outer peripheral portion of said metal vibrating plate; and a pressure-sensitive adhesive layer formed by coating a pressure-sensitive adhesive on said inclined joint surface section;

said outer peripheral portion of said metal vibrating plate being joined through said pressure-sensitive adhesive layer to said inclined joint surface section;

wherein said casing includes a first casing half made of an insulating resin material and including a first opposite wall arranged opposite to one surface of said piezoelectric vibrator and a first peripheral wall arranged so as to extend from an outer peripheral portion of said first opposite wall and a second casing half including a second opposite wall arranged opposite to the other surface of said piezoelectric vibrator and a second peripheral wall arranged so as to extend from an outer peripheral portion of said second opposite wall and fitted to said first peripheral wall of said first casing half;

said first peripheral wall and second peripheral wall being formed on an inner peripheral surface thereof with a first tapered surface section and a second tapered surface section, respectively;

said first and second tapered surface sections cooperating with each other to form an annular groove for fitting said outer peripheral portion of said metal vibrating plate therein when said first and second peripheral walls are fitted to each other;

said first and second tapered surface sections each being inclined so as to permit said groove to enlarge toward a central portion of said casing, one of said first and second tapered surface sections acting as said inclined joint surface section.

6. A piezoelectric acoustic device as defined in claim 5, wherein said first and second casing halves are so configured that said second peripheral wall is fitted in said first peripheral wall;

said first peripheral wall having an opposite surface constituting a part of an inner peripheral surface thereof and arranged opposite to an outer peripheral surface of said second peripheral wall;

said opposite surface of said first peripheral wall and said outer peripheral surface of said second peripheral wall being so configured that said opposite surface is positioned outside a virtual surface defined by a locus of a distal end of said outer peripheral surface of said second peripheral wall when said first peripheral wall and second peripheral wall are fitted to each other and said pressure-sensitive adhesive layer applied to said opposite surface is prevented from being forced out to said groove.

7. A piezoelectric acoustic device as defined in claim 5, wherein said pressure-sensitive adhesive layer is formed into a thickness of 100 $\mu$m or less sufficient to prevent said metal vibrating plate from being contacted directly with said inclined joint surface section.

8. A piezoelectric acoustic device comprising:

a piezoelectric vibrator including a metal vibrating plate and a piezoelectric ceramic element joined to said metal vibrating plate;

a casing constructed so as to receive said piezoelectric vibrator therein and including a first casing half including a first opposite wall arranged opposite to one surface of said piezoelectric vibrator and a first peripheral wall arranged so as to extend from an outer peripheral portion of said first opposite wall and a second casing half including a second opposite wall arranged opposite to the other surface of said piezoelectric vibrator and a second peripheral wall arranged so as to extend from an outer peripheral portion of said second opposite wall and fitted in said first peripheral wall of said first casing half;

said first peripheral wall and second peripheral wall being formed on an inner peripheral surface thereof with a first tapered surface section and a second tapered surface section, respectively;

said first and second tapered surface sections cooperating with each other to form an annular groove for fitting said outer peripheral portion of said metal vibrating plate therein when said first and second peripheral walls are fitted to each other;

said first and second tapered surface sections each being inclined so as to permit said groove to enlarge toward a central portion of said casing, one of said first and second tapered surface sections acting as said inclined joint surface section; and a pressure-sensitive adhesive layer formed by coating a pressure-sensitive adhesive on said inner peripheral surface of said first peripheral wall;

said metal vibrating plate being held at said outer peripheral portion thereof in said casing by means of a portion of said pressure-sensitive adhesive layer positioned in said groove;

said first peripheral wall having an opposite surface constituting a part of an inner peripheral surface thereof and arranged opposite to an outer peripheral surface of said second peripheral wall;

said opposite surface of said first peripheral wall and said outer peripheral surface of said second peripheral wall being so configured that said opposite surface is positioned outside a virtual surface defined by a locus of a distal end of said outer peripheral surface of said second peripheral wall when said first peripheral wall and second peripheral wall are fitted to each other and said pressure-sensitive adhesive layer applied to said opposite surface is prevented from being intruded into said groove.

9. A piezoelectric acoustic device as defined in claim 8, wherein said opposite surface of said first peripheral wall is formed in a manner to be inclined so as to permit a gap between said opposite surface and said outer peripheral surface of said second peripheral wall to be increased in size with an increase in distance by which said opposite surface is separated from said first opposite wall.

10. A piezoelectric acoustic device as defined in claim 8, wherein said opposite surface of said first peripheral wall and said outer peripheral surface of said second peripheral wall are so arranged that an angle therebetween is set to be within a range between 10 degrees and 25 degrees.

11. A piezoelectric acoustic device as defined in claim 8, wherein said metal vibrating plate of said piezoelectric vibrator is formed into a diameter of about 14 mm.

* * * * *